United States Patent [19]

Price, III et al.

[11] 4,399,677

[45] Aug. 23, 1983

[54] APPARATUS FOR MECHANICAL DESCALING OF STEEL WIRE

[75] Inventors: Harry S. Price, III, Spring Valley; Frank W. Brooks, Dayton, both of Ohio

[73] Assignee: Flexiblast Company, Wilmington, Ohio

[21] Appl. No.: 319,822

[22] Filed: Nov. 9, 1981

[51] Int. Cl.[3] ..... B21B 45/04; B21C 43/04; B21D 3/02

[52] U.S. Cl. ..... 72/40; 72/164; 29/81 A; 29/81 F

[58] Field of Search ..... 29/81 A, 81 F; 72/39, 72/40, 160, 162, 164, 165

[56] References Cited

U.S. PATENT DOCUMENTS

| | | | |
|---|---|---|---|
| 1,278,299 | 9/1918 | Brightman | 72/162 |
| 2,242,024 | 5/1941 | Dillon | 29/81 A |
| 2,517,309 | 8/1950 | Heller | 72/162 |
| 3,326,026 | 6/1967 | Guillot | 72/164 X |
| 4,175,412 | 11/1979 | Bernot | 72/40 |
| 4,355,526 | 10/1982 | Miles | 72/164 |

*Primary Examiner*—Ervin M. Combs

*Attorney, Agent, or Firm*—Biebel, French & Nauman

[57] ABSTRACT

Metal wire is descaled by passing it through a series of rollers which bends the wire and causes the scale to loosen and fall off. Two sets of rollers are positioned in planes 90° to each other, through which the wire passes to bend it in different directions. The rollers are pivoted between a wire feed through position and a wire bending position, with the wire bending position being predetermined in relation to the diameter of the wire being descaled. A cam and follower arrangement is provided which upon movement of a center roller causes the breaker rollers to be positioned in the proper location for bending the size of wire being fed through the apparatus.

18 Claims, 13 Drawing Figures

APPARATUS FOR MECHANICAL DESCALING OF STEEL WIRE

BACKGROUND OF THE INVENTION

1. Field of the Invention

The present invention relates to wire descaling apparatus, and more particularly, to mechanical means of descaling steel wire.

2. Prior Art

Devices for the mechanical descaling of wire to which the present invention pertains generally have been well-known in the art for some time. Such devices include a plurality of rollers disposed in two different planes so that the wire is bent in two directions 90° to each other in order to descale the entire circumference of the wire. Such a device is shown, for example, in U.S. Pat. No. 4,175,412.

These devices generally provide two sets of rollers positioned in perpendicular planes. There are usually three rollers on each set; a pair of spaced breaker rollers and a center roller positioned between the breaker rollers. The center roller can be moved between a position where the wire can be fed through the rollers in a straight line during initial set up of the machine, and a position where the rollers are juxtaposed to bend the wire a predetermined amount in order to cause the scaling to flake off as the wire is bent and passes around a portion of the circumference of each roller.

It is known that it is necessary to bend the wire a certain amount in order to cause the scale to come off. The extent of bending varies with the diameter of the wire and therefore the relative positions of the rollers are preferably adjusted for different wire sizes. Generally, this is accomplished by independently adjusting at least the position of the center roller in each set so that the wire either extends a greater or a lesser amount around the circumference of the breaker rollers and center roller.

These devices have generally been designed to descale wire in the range of 7/32 inch (5.5 mm) diameter to 15/32 inch (12 mm) diameter, since greater wire diameters, e.g. 1 inch (25.4 mm), require substantially greater force to bend them sufficiently for descaling. One problem associated with this type of wire descaling in the lower range of wire sizes, and which is even more pronounced in larger diameters of wire, is the wires natural tendency to remain arched as it comes off of the last descaling roller of each set, so that it is either not aligned properly with the next set of descaling rollers or the output guide from the machine. This tends to produce excessive wear and misalignment of the wire, either on the subsequent set of breaker rollers or on the output die which must assist in straightening the wire before it passes onto subsequent processing, for example, a drawing operation.

SUMMARY OF THE INVENTION

The present invention overcomes the above-described difficulties and disadvantages associated with such prior art devices by providing a steel wire descaling apparatus which is capable of descaling a broader range of steel wire and which aligns and straightens the wire after passing through the descaling or breaker rollers so that less wear is effected on subsequent rollers and output guides of the apparatus. Additional advantages will be evident from the following disclosure.

The device includes a closed housing through which the wire can pass. Operation of the device produces a significant amount of dust which it is desirable to collect and use to provide additional descaling of the wire. This is done by what is essentially a sandblasting technique, utilizing the scale removed from the wire during the bending operation to remove additional scale and provide a bright finish on the wire before it passes out of the device. Such a sandblasting technique is well-known in the art and is described, for example, in the above-referred to United States patent.

Contained within the housing are two sets of rollers. The rollers of a first set are positioned for rotation within the housing so as to bend the wire in a first plane. The rollers of a second set are mounted within the housing so as to receive the wire from the first set of rollers and bend it in a second plane perpendicular to the first plane, in order to cause the wire to be bent about two perpendicular axes as it passes through the device.

Each of these sets of rollers has at least two pairs of breaker rollers and a center roller disposed between the pairs of breaker rollers. This is in contrast to the prior art which has only a single roller on each side of the center roller. The wire passes through the pairs of breaker rollers so that the rollers of each pair are on opposite sides of the wire. The pairs of rollers are mounted for pivotal movement about an axis perpendicular to and preferably extending through the center of the wire so that as they are pivoted about this axis they tend to bend the wire slightly. This has significant advantage over the prior art devices in that on the output of the sets of rollers the wire tends to be straightened and aligned for either the next set of rollers or output from the device. This reduces jamming of the equipment and wear on the rollers and output alignment mechanism.

Means, such as a cam and follower arrangement, are used to pivot the pairs of rollers on their mounts a predetermined amount relative to the diameter of the wire so that the wire is bent sufficiently to cause the scale to flake off. Such relationships are well-known in the art and will therefore not be discussed in detail herein.

The center rollers are each mounted for movement between a position out of engagement with the wire, so that the wire can initially be fed through the device in a straight line, and a position engaging the wire and bending it a predetermined amount in relation to the diameter of the wire in order to cause the necessary bending for descaling, as mentioned above. In the preferred embodiment, the means for rotating the breaker rollers into the desired position and for also moving the center roller into the desired position, are interconnected so that all of the movement takes place simultaneously after the straight wire has been initially fed through the rollers and the remaining parts of the apparatus. However, this could be done in a timed relationship or independently, if that is desired.

In the preferred form of the device, the center roller is drawn toward the position between the two pairs of breaker rollers by a double-acting pneumatic cylinder motor. A pair of camming surfaces are mounted to the movable support for the center roller and are drawn with it as the center roller is moved into its operative position. A pair of cam follower rollers, one on each side of the center roller, are mounted to the means supporting the pairs of breaker rollers and thus, as the center roller is pulled into position, the cam followers track the cam surface and force the pivoting of the breaker roller mounts so that the breaker rollers are simultaneously moved into the desired position as the center roller is moved.

The angle of the camming surface determines the amount of rotation of the breaker rollers about their pivotal axes so that the wire is bent the desired amount. It is desired that the pivotal axis of the pairs of breaker rollers extend through the axis of the wire in the unbent position so that the input and output positions of the wire are maintained in essentially the same location. Thus, no additional misalignment is produced with either the initial infeed and outfeed positions of the device or the relative locations of the output rollers on the first set and the input rollers on the second set.

Often, there are "knots" or irregularities in the wire which must pass through the sets of rollers since the wire is drawn continuously through the device. Such irregularities in the wire can cause significant increases in the forces imposed on the apparatus and could either cause breakage or undue wear of the rollers and their supporting members. In order to alleviate this possible problem, the center roller is preferably supported by a resilient mounting on the pneumatic cylinder motor which pulls the center roller toward its position between the pairs of breaker rollers. The resilient mounting permits the center roller to move slightly outwardly from its normal operative position in order to allow such an irregularity to pass through the set of rollers without causing damage thereto.

In the prior art apparatus a set of guide dies is utilized at the input and output ends of the housing to align the wire on the input side with the sets of breaker rollers, and to align the wire on the output side with the subsequent processing equipment, such as a drawing machine. These dies show significant wear and generally require frequent replacement in order to keep the wire properly aligned as it passes through the equipment.

In the present invention, this problem has been substantially reduced by the use of the pairs of breaker rollers which straighten and align the wire. This problem has been further reduced through the use of guide means at each end of the housing which contain two pairs of centering rollers disposed mutually perpendicular about the path of the wire. The mutually perpendicular sets of rollers are supported by a camming surface which when rotated causes the rollers to simultaneously move an equal distance towards and away from the desired center line of the wire and thus can be adjusted for any desired wire size which will be passed through the device.

DETAILED DESCRIPTION OF THE PREFERRED EMBODIMENT

Figure 1:
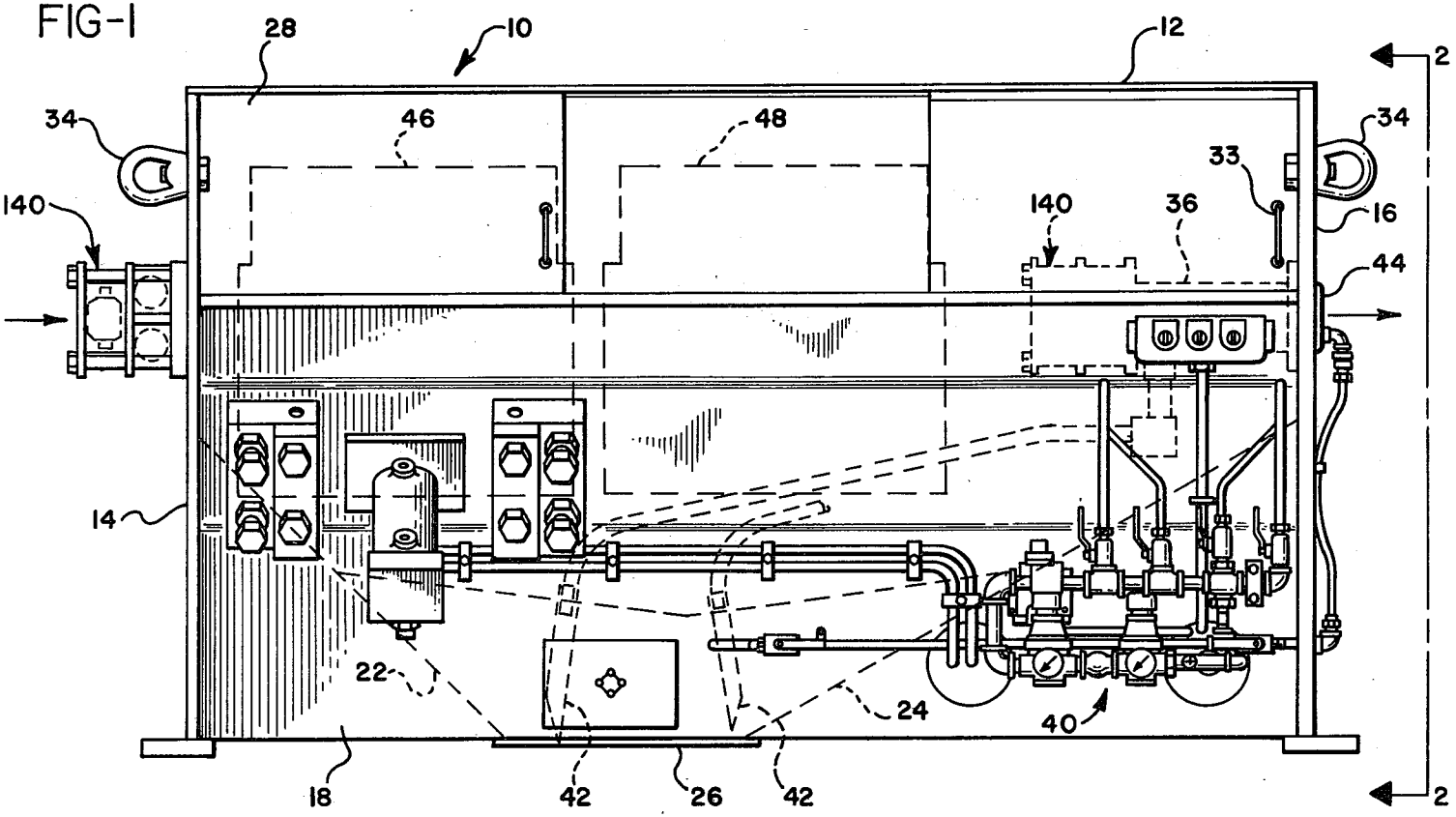
FIG. 1 is a side view of the exterior housing of the preferred embodiment.

The mechanical descaling apparatus 10 includes a housing 12 which encloses the actual descaling equipment in order to prevent loss of the dust produced during the processing of wire through the device, and to accumulate the dust and heavier scale for use in the sand blasting feature of the apparatus. The housing includes two vertical end walls 14, 16 with openings through which the wire may pass to be operated on by the apparatus. Extending between these two end walls are a pair of contoured plates 18, 20 which form the sides of a trough for collecting the scale. Further plates 22, 24 extend between plates 18, 20 at angles which complete the collection trough and direct the scale towards the scale removal opening 26, through which scale is no longer suitable for use is removed from the apparatus.

The two covers 28, 30 which form the upper closure of the apparatus are hinged along their length by hinge members 32 which permits the covers to be lifted for inspection and setting of the positions of the adjusting apparatus described below. Lifting eyes 34 are bolted to each end of the apparatus so that it may be moved by an overhead crane or the like, since it is a relatively heavy apparatus.

Mounted internally of the housing 12 to the vertical end wall 16 is a blasting chamber 36 through which the wire passes. The blasting chamber 36 basically includes a plurality of nozzles disposed around the periphery of the wire path and aimed so that a mixture of air and scale removed from the wire being descaled, impinge upon the wire and remove further scale therefrom.

The details of the blasting chamber 36 will not be discussed in detail herein since the present invention is not directed to that aspect of a wire descaling apparatus and a basic concept of such a blasting chamber is fully disclosed in U.S. Pat. No. 4,175,412, to which reference should be made for any further information regarding that portion of the device. Air under pressure is supplied to the blasting chamber 36 through the plurality of pressure lines and valves, generally illustrated at 40 in FIG. 1.

The scale removed from the wire during the descaling process is introduced into the air mixture for the blasting chamber by the suction lines 42 which extend into the trough in the bottom of housing 12. A clean air blast ring 44 is mounted around the outlet opening of the apparatus, through which the wire passes as it is being processed so that as much as possible of the scale from the blasting chamber is removed before the wire leaves the apparatus. The reason for this is to reduce the wear on components of subsequent processing machinery such as wire drawing apparatus.

Figure 2:
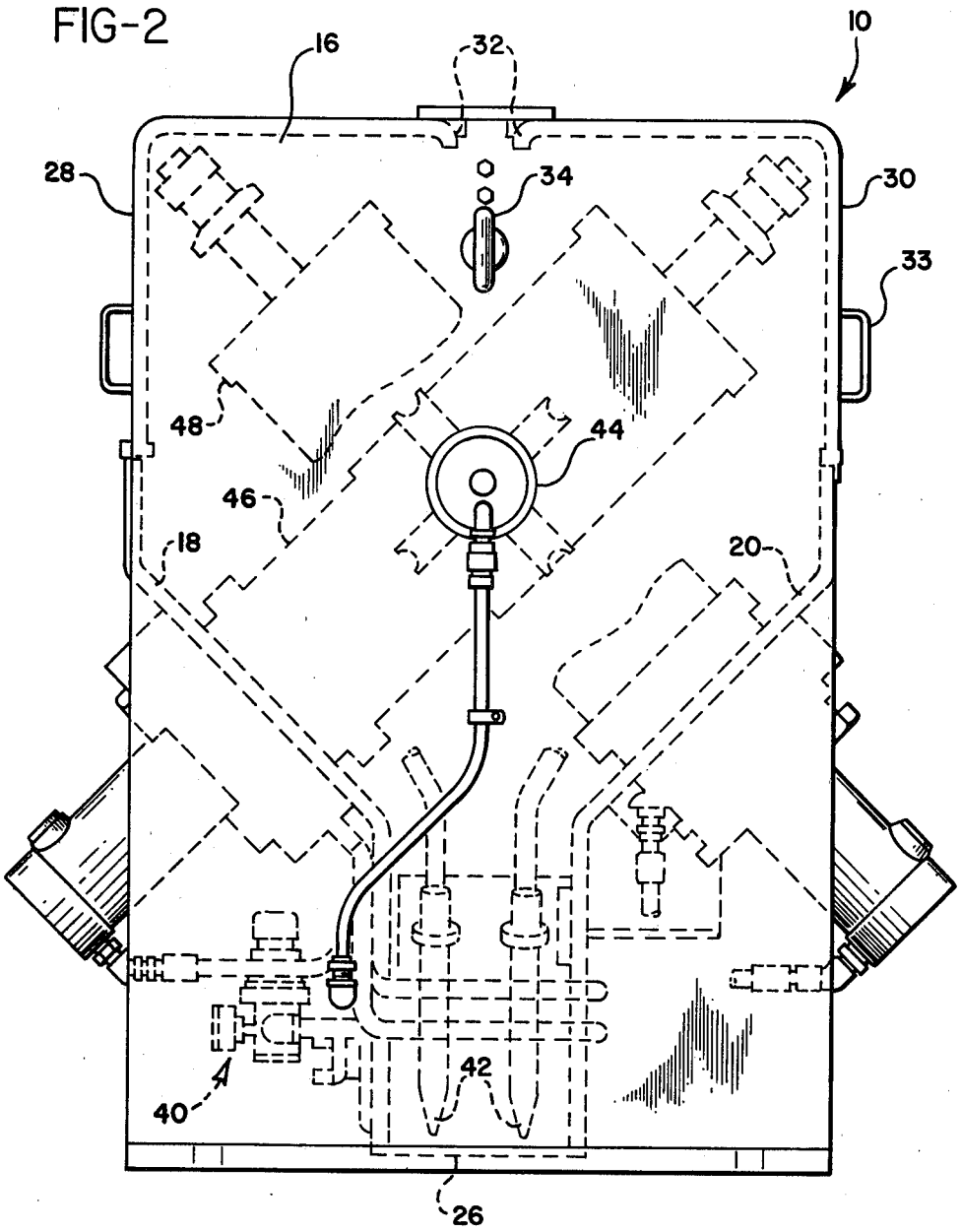
FIG. 2 is an end view of the embodiment of FIG. 1 illustrating in hidden outline form the perpendicular positions of the two sets of rollers.

Referring now to the descaling roller assemblies to which the present invention is directed, two such assemblies are preferably utilized and their position in the housing 12 is illustrated generally by the outlines 46, 48 in FIGS. 1 and 2. Each of the roller assemblies 50 are bolted to the contoured plates 18, 20, respectively, adjacent one another and in mutually perpendicular positions, as best seen in FIG. 2. Since each of the actual roller assemblies 50 are the same, only one of them will be described in detail, with particular reference to FIGS. 3, 4, 8 and 9.

Figure 3:
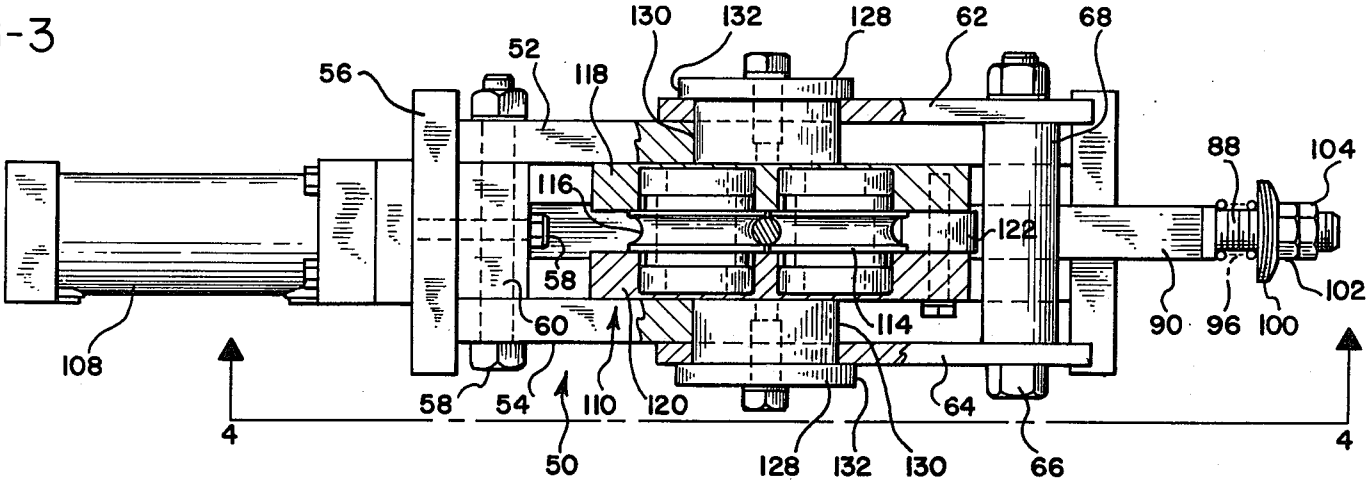
FIG. 3 is an enlarged side view of a set of rollers and their mounting and hydraulic cylinder motor operating mechanism, removed from the housing.
Figure 4:
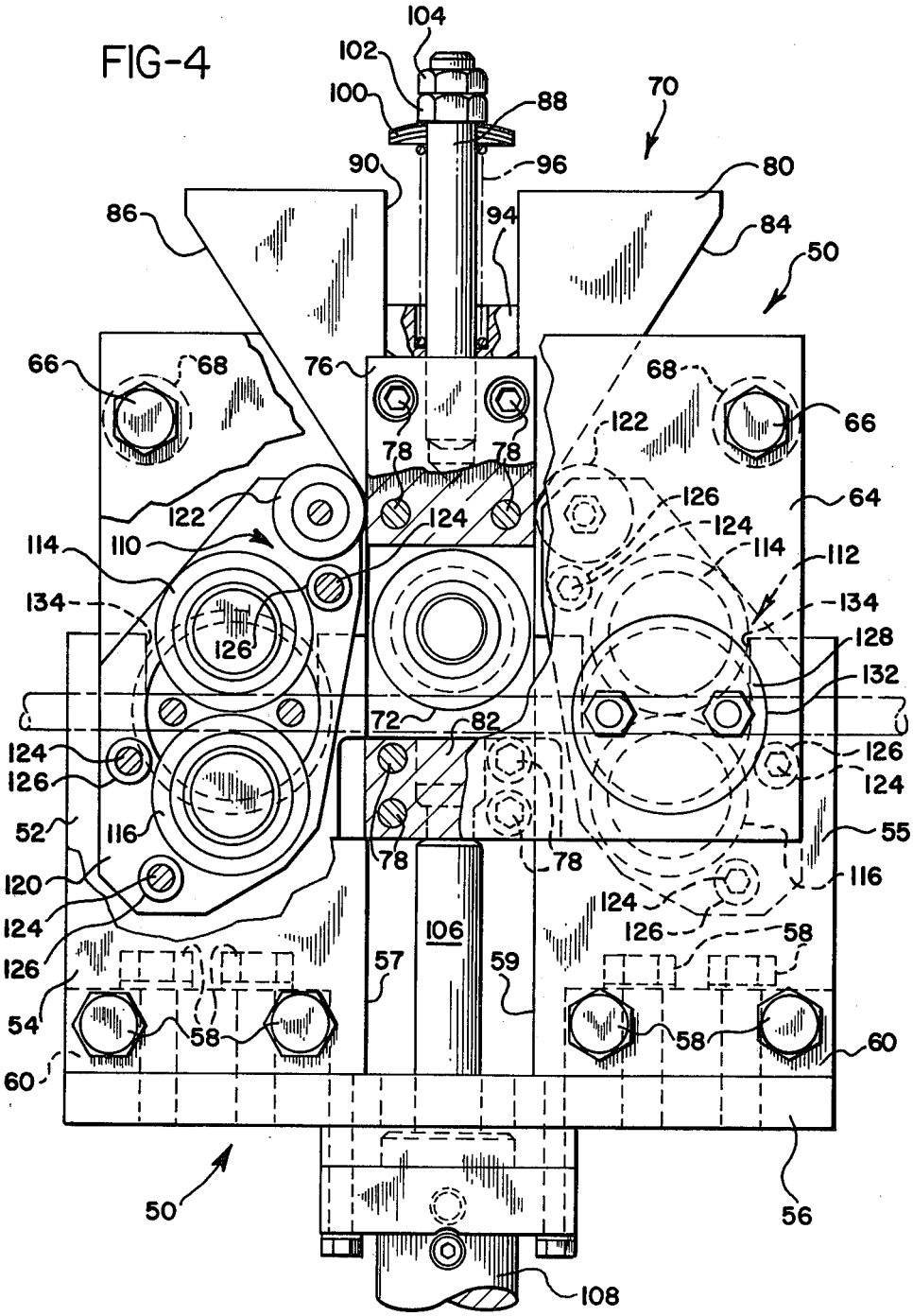
FIG. 4 is a front view of the set of rollers of FIG. 3, partially broken away to show the camming surface and breaker roller mounting.

The roller assembly 50 includes two sets of interengaging plates. The first set of plates 52, 53 (not shown), 54 and 55 are mounted to a backing plate 56 by bolts 58 and blocks 60 as best seen in FIGS. 3 and 4. Each of these plates is rectangular with a U-shape opening at one end to receive a trunnion bearing as described below. The plates 54 and 55, as seen in FIG. 4, provide a space between their adjacent edges 57 and 59, respectively. The same spacing exists between plates 52 and 53 which would be disposed directly beneath plates 54 and 55 as shown in FIG. 4.

A rectangular plate 62 overlaps the end of plates 52 and 53, and an identical plate 64 overlaps plates 54 and 55. Plates 62 and 64 are held together by bolts 66 which extend through the two spacers 68 that hold these plates the proper distance apart.

Figure 8:
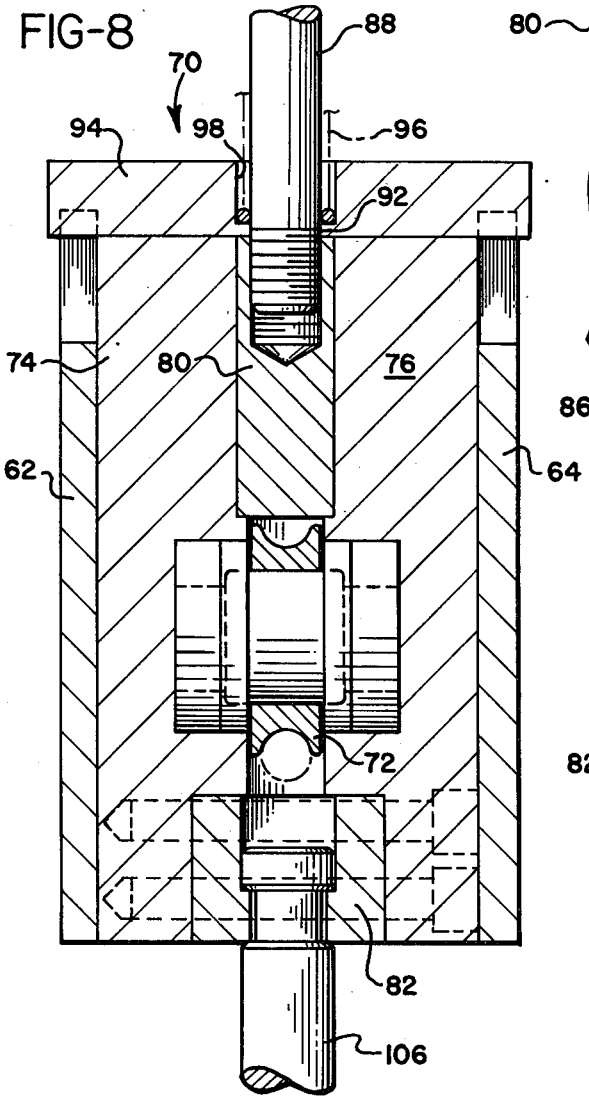
FIG. 8 is a cross sectional view through the center roller mounting means of FIG. 9.
Figure 9:
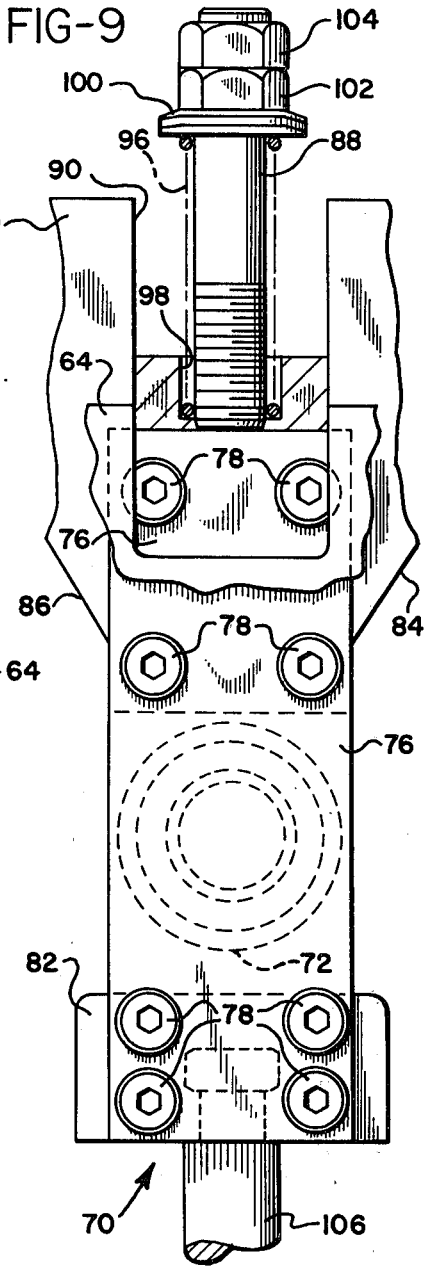
FIG. 9 is a front view of the center roller mounting means and the camming member partially cut away.
Figure 10:
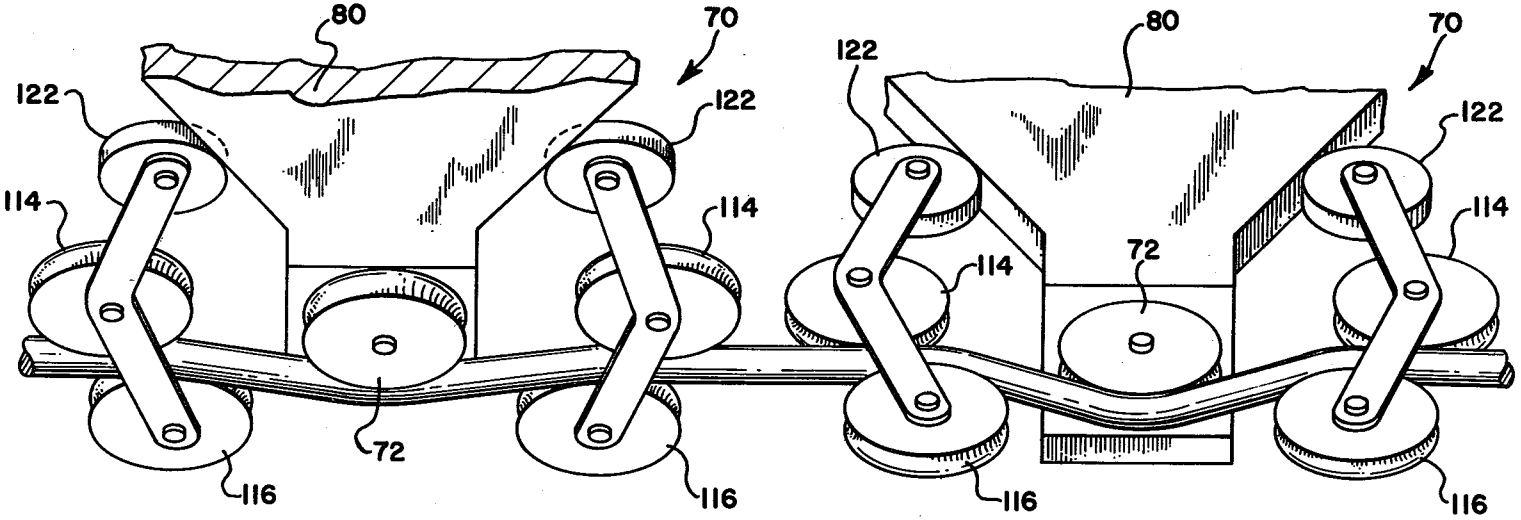
FIG. 10 is a pictorial illustration of the relative positions of the two sets of rollers in the preferred embodiment, disposed in mutually perpendicular planes and illustrating the passing of a relatively large diameter wire through both sets of rollers in their operative position.

A center roller subassembly 70, as best seen in FIGS. 8 and 9, extends through the central region of roller assembly 50 and holds the roller assembly together, as will be more evident from the following description. The center roller subassembly 70 contains a center roller 72 supported in a bearing mount in top and bottom plates 74 and 76 which, in turn, are held together by bolts 78.

Sandwiched between top and bottom plates 74 and 76 are a camming plate 80 and a rod attaching block 82, which are also held in position by the plurality of bolts 78. Camming plate 80 is provided with a pair of opposed camming surfaces 84 and 86 of predetermined angle for proper movement of the breaker rollers as is discussed more fully below. In the preferred embodiment, the angle between these surfaces is approximately 67°. However, this angle depends on the geometry of the breaker roller assemblies and the required amount of movement to achieve the desired amount of bending in the wire and is thus not critical in and of itself.

The camming surfaces 84 and 86 extend rearwardly out from between the top and bottom plates 74 and 76. An adjusting shaft 88 is threaded into a U-shaped recess portion 90 in camming plate 80 and extends rearwardly from the assembly beyond the outer edges of the camming plate 80. Adjusting shaft 88 extends through a hole 92 in a stop block 94. The diameter of hole 92 is sufficient to allow the stop block 94 to move axially along the adjusting shaft 88 without engaging the threaded portion of the shaft.

The stop block 94 is of generally rectangular cross-section and extends through the U-shaped recess 90 in camming plate 80 and through corresponding recesses in plates 62 and 64, so that the stop block is captive from rotation and yet free to slide through these recesses as the center roller subassembly 70 moves. A coil spring 96 of slightly larger diameter than adjusting shaft 88 rides on shaft 88 with one end extending into a cylindrical recess 98 in stop block 94. The other end of spring 96 engages a series of bellville washers 100 mounted to the adjusting shaft 88 by nut 102 and locking nut 104. When fully compressed, spring 96 fits completely within recess 98 to permit the bellville washers 100 to engage the surface of stop block 94. The spring 94 is kept under sufficient compression, even in the extended position shown in FIG. 4, to keep the stop block 94 engaged with the rear surfaces of top and bottom plates 74 and 76, but the block is otherwise free for axial movement along the adjusting shaft 88 against the bias of spring 96.

The rod attaching block 82 holds captive the end of a piston rod 106 of a double-acting hydraulic cylinder motor 108 which pushes and pulls the center roller subassembly 70. Hydraulic cylinder motor 108 is securely mounted to the outside surface of backing plate 56, and piston rod 106 extends through a corresponding opening in backing plate 56 so that it is free for movement therein. The rod attaching block 82 is actually in two pieces so that when the center roller subassembly 70 is disassembled by the removal of bolts 78 the captive end of the piston rod 106 can be removed from the recesses within the attaching block 82.

Mounted between the pairs of plates 52, 53 and 54, 55 are a pair of breaker roller subassemblies 110 and 112, as shown in FIG. 4, which are disposed on opposite sides of the center roller subassembly 70. Each of the breaker roller subassemblies 110 and 112 contains a pair of breaker rollers 114 and 116 which are each mounted through bearing assemblies to upper and lower trunnion plates 118 and 120. A camming roller 122 is also sandwiched between upper and lower trunnion plates 118 and 120 of each of the breaker roller subassemblies 110 and 112, and one rides on each of the camming surfaces 84 and 86. A plurality of bolts 124 hold the upper and lower trunnion plates together while spacers 126 extending between the trunnion plates 118 and 120 keep the proper spacing between them.

Each of the breaker roller subassemblies 110 and 112 are supported for rotation between plates 62 and 64 by trunnion bearings 128. Each of the trunnion bearings 128 consists of a cylindrical bearing surface 130 and a larger diameter lip 132 which rests on the outer surface of plates 62 and 64. Trunnion bearings 128 rotate in corresponding cylindrical holes formed in plates 62 and 64. The axis of rotation of each of the trunnion bearings is perpendicular to and extends through the center line of the wire which will pass through the roller assemblies 50 when in their inoperative position, i.e., when the wire is in a straight line extending through the device.

The breaker rollers 114 and 116 are positioned in the breaker roller subassemblies 110 and 112, equidistant from the axis of rotation of the trunnion bearings so that the pairs of breaker rollers will rotate about this axis when the breaker roller subassemblies 110 and 112 are rotated. This is an important feature of the present invention in that it aids in the aligning and straightening of the wire as it is fed through each of the roller assemblies 50.

Since the trunnion bearings 128 extend through the plates 52, 53 and 54, 55 corresponding U-shaped openings 134 are provided to receive the trunnion bearings, as previously mentioned. In this manner the trunnion bearings 128 and the breaker roller subassemblies 110 and 112 can be preassembled between plates 62 and 64 and slid into position in the U-shaped openings 134. Thus, the entire roller assembly 50 can be held together by only the adjusting shaft 88, which holds the center roller subassembly together as well. This feature provides easy disassembly for maintenance and changing or adjusting of parts.

As can be seen in FIGS. 3 and 4, when the pneumatic cylinder motor 108 is activated to pull the piston rod 106 towards it, this causes the center roller subassembly 70 to be drawn towards it thus causing the plates 74 and 76 to slide between the plates 62 and 64 and through the openings between adjacent plates 52, 53 and 54, 55 so that surfaces 57 and 59 act as guides for the center roller subassembly 70. Also, the rod attaching block 82, which is wider than plates 74 and 76 slides between the plates 52, 53 and 54, 55 towards the hydraulic cylinder motor 108.

As this occurs, the cam rollers 122 roll along the camming surfaces 84 and 86 thus causing rotation of the breaker roller subassemblies 110 and 112 about their pivotal axes defined by the trunnion bearings 128. This in turn causes the breaker rollers 114 and 116 to bend the wire passing through them simultaneously with the bending of the wire caused by center roller 72 as it is moved to its operative position.

It is noted that although the stop block 94 bottoms against the plates 62 and 64 in the U-shaped recesses thereof, further movement of the rest of the center roller subassembly 70 is permitted by overcoming the spring force of the coil spring 96. This movement continues until the bellville washers 100 engage the outer surface of stop block 94. This is the desired final position of movement of the center roller assembly 70 so that the center roller 72 is now properly located for bending of the wire.

The bellville washers 100 provide a relief for irregularities on the wire which may pass through the device and thus prevent the necessity of permitting the hydraulic motor 108 to relieve pressure in order to prevent damage to the system as such irregularities pass through. In order to adjust the stop height of the center roller, the nut 102 and 104 can be adjusted axially of the adjusting shaft 88 a predetermined distance depending upon the diameter of the wire to be bent.

Figure 12:
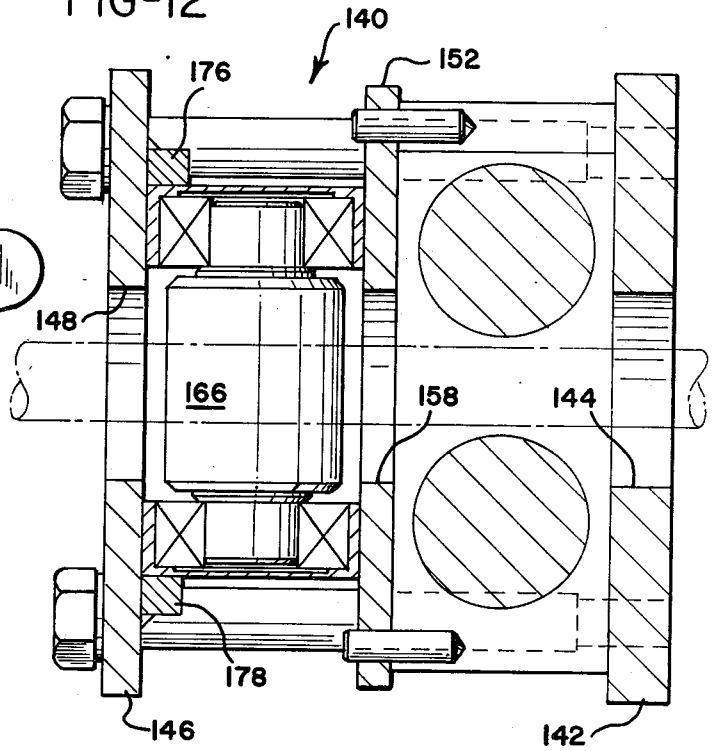
FIG. 12 is a cross sectional view through the guide means of FIG. 11.
Figure 11:
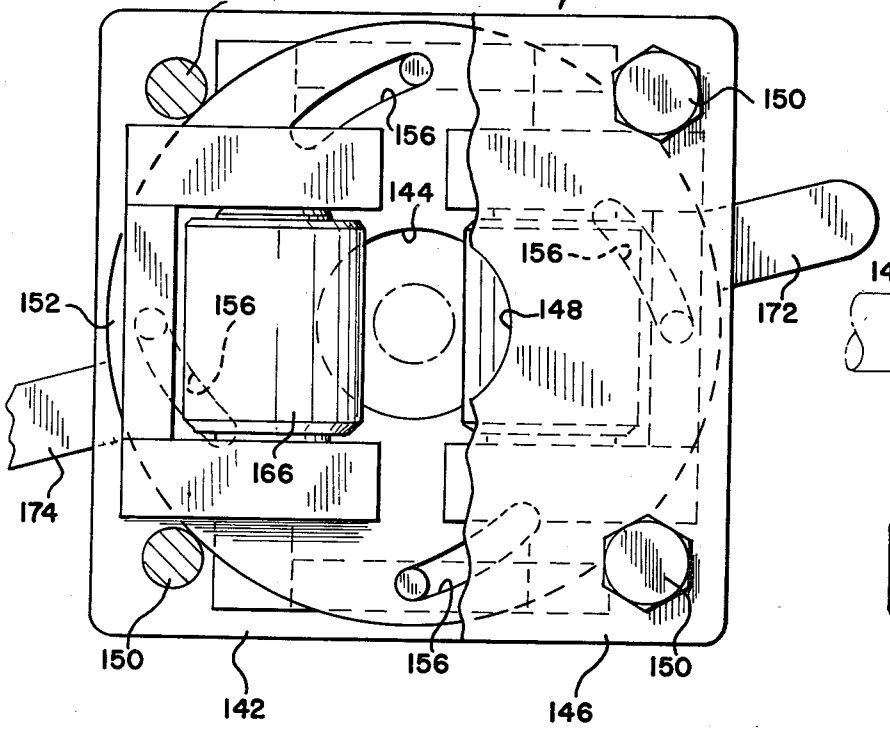
FIG. 11 is a front view of the guide means of the present invention.

Referring to FIGS. 1, 11 and 12, a wire guide means 104 is provided at each end of the path of wire through the device, before and after it is passed through the two perpendicularly disposed roller assemblies 50. The downstream wire guide means 40 is positioned in front of the blasting chamber 36 in order to properly center the wire for passing through this chamber.

Wire guide means 140 includes a rectangular base plate 142 through which the wire guide means 140 is bolted in position on the mating flat surface of either the vertical end wall 14 or the end plate of blasting chamber 36. A central opening 144 is provided in the base plate 142, of sufficiently large diameter to permit the wire to pass therethrough. An outer rectangular plate 146 is likewise provided with a circular opening 148 of sufficiently large diameter to permit the wire to pass therethrough unhindered. Four bolts 150 extend through both the outer plate 146 and base plate 142 into the surface to which the guide means 140 is to be mounted.

A central circular camming plate 152 is positioned between base plate 142 and 146 and is of a diameter which permits it to rotate freely within the bolt pattern formed by the bolts 150. Camming plate 152 also has a circular opening 158 through which the wire may pass freely. Camming plate 152 also has equally angularly spaced camming slots 156 formed therein which are directed spirally inward towards the center of camming plate 152, which center is coincident with the desired axis of the wire. Slots 156 need not be exactly spiral in their arc, but must progress inward at identical arcs so that all of the rollers, described below, are simultaneously moved an equal amount.

Figure 13:
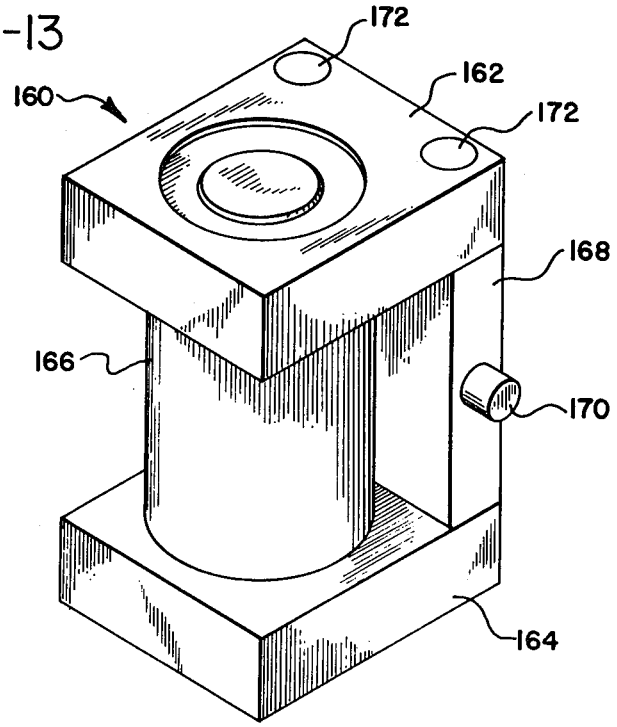
FIG. 13 is an enlarged pictorial view of the guide roll assembly for the wire guide means.

A group of four guide roller assemblies 160, one of which is illustrated pictorially in FIG. 13, are contained in wire guide means 140. Each guide roll assembly comprises a pair of end plates 162 and 164, a guide roller 166 supported at its ends by plates 162 and 164, and a connecting plate 168 which is provided with a camming pin 170. Each of the end plates 162 and 164 are secured to opposite ends of connector plate 168 by bolts 172. The camming pin 170 can be in the form of a dowel which is either threaded or force fitted into a corresponding opening in connector plate 168.

Four of these guide roll assemblies 160 are then positioned between the base plate 142, outer plate 146 and camming plate 152, as shown in FIGS. 11 and 12, with the camming pins 170 positioned in corresponding camming slots 156. Thus, there are two guide roll assemblies 160 positioned between outer plate 146 and camming plate 152 and another pair of guide roll assemblies 160 disposed perpendicular to the first two assemblies and sandwiched between base plate 142 and camming plate 152. As camming plate 152 is rotated, for example, clockwise as illustrated in FIG. 11, the four guide roll assemblies 160 will be simultaneously moved inwardly an equal amount so that any wire diameter passing through the guide roll means 140 will be centered on a single central axis.

In order to assist in the manual rotation of the camming plate 152, a pair of lever arms 172 and 174 are secured by welding or the like to opposite sides of camming plate 152. If desired, means (not shown) could also be provided for holding the camming plate in a position if this is desired.

A pair of guide rails 176 and 178 are welded to the inside surface of outer plate 146 for guiding the upper pair of guide roll assemblies 160 as they are moved inwardly and outwardly by camming pins 170. These guide rails maintain the guide rollers 166 with their axes parallel as they are moved inwardly and outwardly by camming plate 152. A similar pair of guide rails (not shown) are welded to base plate 142 and guide the other pair of guide roll assemblies 160 in the same manner.

Referring now to the manner in which the wire descaling apparatus 10 of the present invention operates, a wire within the acceptable range of diameters referred to, is fed through the first wire guide means 140 at the entrance end of the apparatus and is threaded through each of the two roller assemblies 50 by an operator who reaches through the hinged covers 28 and 30. The wire is then fed through the second wire guide means 140, then through the blasting chamber 36 and out through the clean air blast ring 44. Each of the wire guide means 140 is then adjusted to engage and center the wire.

Figure 5:
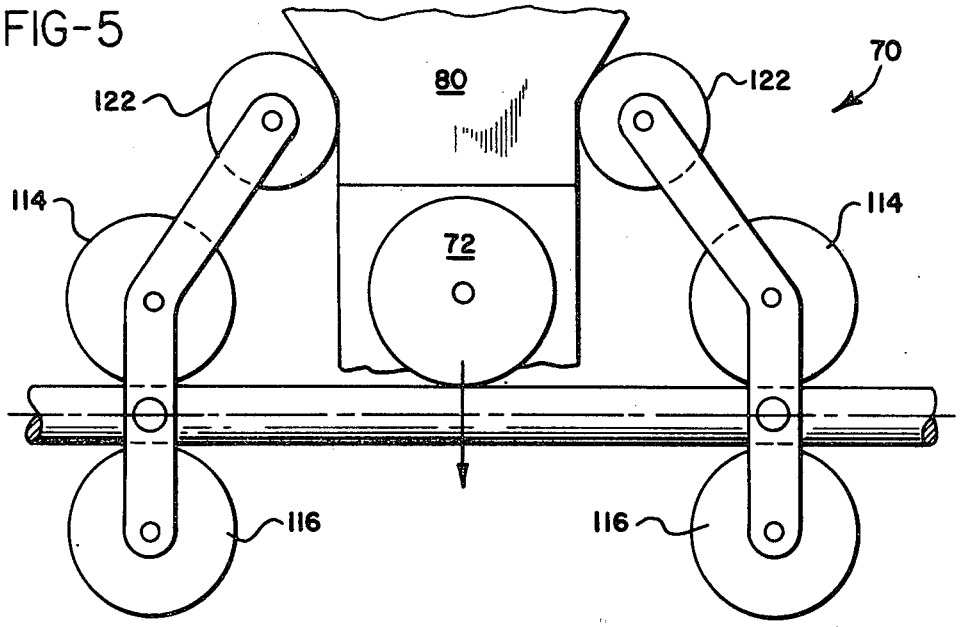
FIG. 5 is a schematic illustration of the relative positions of breaker rollers and center roller in the inoperative position.
Figure 6:
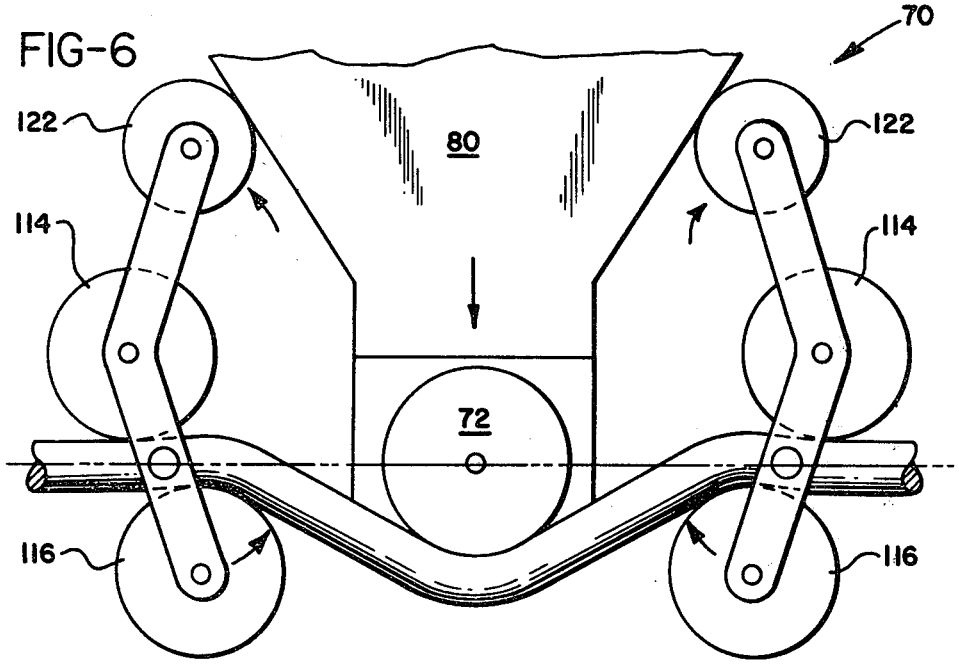
FIG. 6 is a schematic illustration as in FIG. 5, but with the center roller drawn into the operative position and the breaker rollers moved into their operative positions when a relatively large diameter wire is being descaled.

During operation, the wire is pulled through the apparatus by subsequent equipment such as wire drawing equipment, as previously mentioned. After the wire has been initially fed through and is in a straight line from one end of the apparatus to the other, with each of the roller assemblies 50 disposed with the various rollers as illustrated schematically in FIG. 5, the hydraulic cylinder motors 108 are activated to draw the center roller subassemblies 70 into the wire, as illustrated in FIG. 6.

It is to be noted that the position of the nut 102 and lock nut 104 on the end of each of the adjusting shafts 88 has been previously positioned to allow the appropriate amount of movement of each of the center rollers 72 so that the wire being descaled has the proper amount of bending as it passes around these center rollers. Also, as illustrated in FIG. 6, simultaneously with the movement of the center roller into the wire, the two camming rollers 122 roll up the camming surfaces 84 and 86 causing rotation of the pairs of breaker rollers 114 and 116 which causes some bending of the wire.

Figure 7:
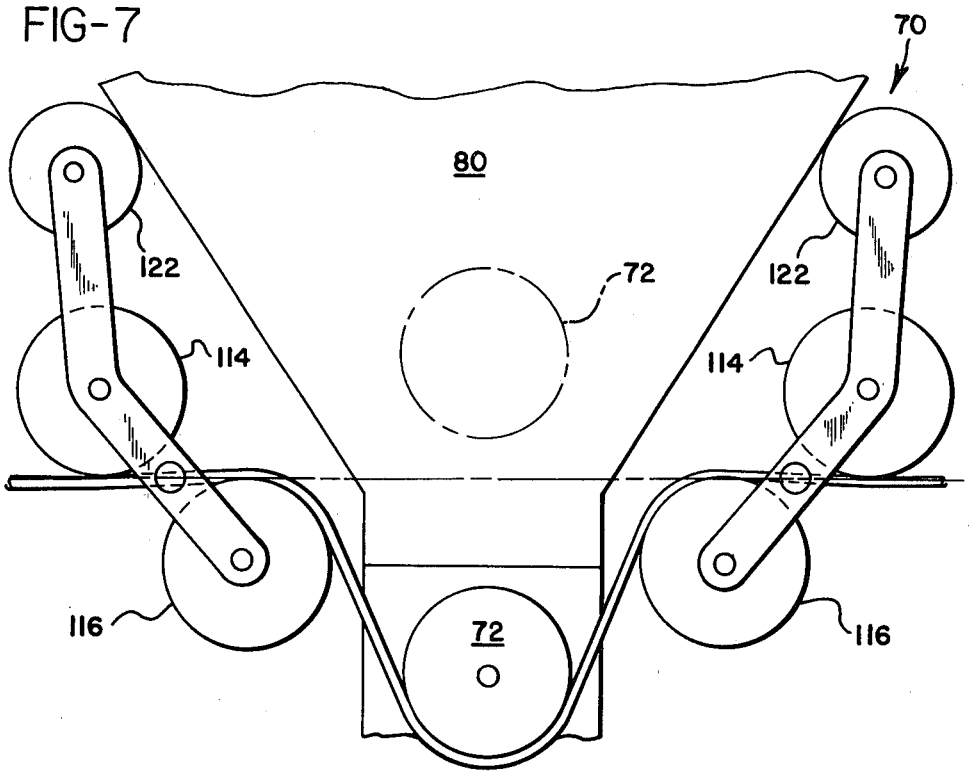
FIG. 7 is a schematic illustration as in FIG. 6, but with a smaller diameter wire passing through the breaker and center rollers.

As illustrated in FIG. 7, each of the center rollers 72 is moved a greater distance from its inoperative position to its operative position when bending a smaller diameter of wire than when bending a larger diameter of wire. Again, this adjustment is obtained by adjusting the position of nut 102 and lock nut 104 on the end of adjusting shaft 88 for each of the roller assemblies 50. This likewise causes a difference in the rotation of the breaker rollers 72.

The scale thus removed by reverse bending of the wire drops into the trough formed in the bottom of the apparatus and is removed through suction lines 42 which then mixes the scale with a regulated amount of air. This mixture is then directed against the descaled wire in the blast chamber 36. The wire which then passes out of the chamber has clean air applied to it through the clean air blast ring 44 so that the wire is as clean as possible as it leaves the device.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An apparatus for descaling steel wire, comprising:

a housing through which wire to be descaled can pass;

a first set of rollers mounted for rotation within the housing and about which wire to be descaled passes and is bent in a first plane;

a second set of rollers mounted for rotation within the housing and disposed downstream in the direction of movement of the wire from the first set of rollers and about which the wire is bent in a second plane perpendicular to the first plane;

each set of rollers having two pairs of breaker rollers and a center roller disposed between the pairs of breaker rollers;

means mounting the pairs of rollers on opposite sides of the wire for pivotal movement about an axis perpendicular to the wire;

means for pivoting the means mounting the pairs of rollers into predetermined positions relative to the diameter of the wire for bending the wire a predetermined amount; and means mounting the center rollers for movement between a position out of engagement with the wire and an adjustable position engaging the wire and bending it a predetermined amount in relation to the diameter of the wire.

2. The apparatus of claim 1 wherein said means mounting the center rollers in each said set of rollers, includes:

resilient means for holding said center roller in engagement with the wire with a predetermined force such that a greater force applied by the wire to said center roller will cause it to deflect so as to reduce the force.

3. The apparatus of claim 1, wherein said means for pivoting the means mounting the pairs of rollers includes:

cam and follower means interengaging said means mounting the pairs of rollers and said means mounting said center rollers in each said set for simultaneous movement of said pairs of rollers and center rollers in each said set, into and out of engagement with the wire.

4. The apparatus of claim 3 wherein said cam and follower means includes:

camming surfaces secured to said means for mounting said center rollers for movement therewith;

cam followers secured to said means mounting said breaker rollers for movement therewith and engaging said camming surfaces; and said camming surfaces being contoured to simultaneously move said breaker rollers between said positions.

5. The apparatus of claim 3 wherein the axis of pivotal movement of said means mounting the pairs of rollers passes through the centerline of the wire and the axis of rotation of each breaker roller is equidistant from the axis of pivotal movement of said means mounting the pairs of rollers.

6. The apparatus of claim 5 including:

a pair of wire guide means mounted in said housing, one each on opposite sides of said sets of rollers for guiding said wire into and out of said sets of rollers and having means for centering a range of diameters of wires with respect to said breaker rollers.

7. The apparatus of claim 6 wherein said centering means in each wire guide means includes:

a first pair of centering rollers having parallel axes of rotation disposed in a first plane perpendicular to the path of the wire;

a second pair of centering rollers having parallel axes of rotation disposed in a second plane parallel to and offset from said first plane and perpendicular to said axes of said first pair of centering rollers;

means mounting each said centering roller to said housing for movement towards and away from said wire path; and camming means engaging said centering roller mounting means for simultaneous movement of all of said centering rollers toward and away from the wire for causing said centering rollers to be equidistant therefrom so as to center the wire on said wire path within a predetermined range of wire diameters.

8. The apparatus of claim 1 wherein said breaker rollers are so disposed during bending of the wire that said wire is straightened after it leaves each set of breaker rollers.

9. The apparatus of claim 8 wherein said breaker rollers are so disposed during bending of the wire that said wire is centered between each said pair of breaker rollers.

10. In an apparatus for the mechanical descaling of steel wire, including a first set of rollers about which wire to be descaled passes and is bent in a first plane, a second set of rollers disposed downstream in the direction of movement of the wire from the first set of rollers and about which the wire passes and is bent in a plane perpendicular to the first plane, each set of rollers including a center roller movable between a position out of engagement with the wire into a position engaging and bending the wire a predetermined amount, wherein the improvement comprises:

each set of rollers having two pairs of breaker rollers disposed on opposite sides of the center roller;

means mounting the pairs of rollers on opposite sides of the wire for pivotal movement about an axis perpendicular to the wire; and means for pivoting the means mounting the pairs of rollers into predetermined positions relative to the diameter of the wire for bending the wire a predetermined amount.

11. The improvement of claim 9, wherein said means for pivoting the means mounting the pairs of rollers includes:

cam and follower means interengaging said means mounting the pairs of rollers and said means mounting said center rollers in each said set for simultaneous movement of said pairs of rollers and center rollers in each said set, into and out of engagement with the wire.

12. The improvement of claim 11 wherein said cam and follower means includes:

camming surfaces secured to said means for mounting said center rollers for movement therewith;

cam followers secured to said means mounting said breaker rollers for movement therewith and engaging said camming surfaces; and said camming surfaces being contoured to simultaneously move said breaker rollers between said positions.

13. The improvement of claim 12 wherein the axis of pivotal movement of said means mounting the pairs of rollers passes through the centerline of the wire and the axis of rotation of each breaker roller is equidistant from the axis of pivotal movement of said means mounting the pairs of rollers.

14. The improvement of claim 13 including:

a pair of wire guide means mounted in said housing, one each on opposite sides of said sets of rollers for guiding said wire into and out of said sets of rollers and having means for centering a range of diameters of wires with respect to said breaker rollers.

15. The improvement of claim 14 wherein said centering means in each wire guide means includes:

a first pair of centering rollers having parallel axes of rotation disposed in a first plane perpendicular to the path of the wire;

a second pair of centering rollers having parallel axes of rotation disposed in a second plane parallel to and offset from said first plane and perpendicular to said axes of said first pair of centering rollers;

means mounting each said centering roller to said housing for movement towards and away from said wire path; and camming means engaging said centering roller mounting means for simultaneous movement of all of said centering rollers toward and away from the wire for causing said centering rollers to be equidistant therefrom so as to center the wire on said wire path within a predetermined range of wire diameters.

16. The improvement of claim 10 wherein said means mounting the center rollers in each said set of rollers, includes:

resilient means for holding said center roller in engagement with the wire with a predetermined force such that a greater force applied by the wire to said center roller will cause it to deflect so as to reduce the force.

17. The improvement of claim 10 wherein said breaker rollers are so displaced during bending of the wire that said wire is straightened after it leaves each set of breaker rollers.

18. The improvement of claim 17 wherein said breaker rollers are so disposed during bending of the wire that said wire is centered between each said pair of breaker rollers.

* * * * *